US007401444B2

(12) United States Patent
Krämer et al.

(10) Patent No.: US 7,401,444 B2
(45) **Date of Patent: *Jul. 22, 2008**

(54) BEVERAGE BOTTLING PLANT FOR FILLING BOTTLES WITH A LIQUID BEVERAGE FILLING MATERIAL HAVING AN INFORMATION ADDING STATION

(75) Inventors: Klaus Krämer, Dortmund (DE); Siegmar Sindermann, Kamen (DE); Martin Schach, Bochum (DE); Winfried Schlüter, Horstmar (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/676,757

(22) Filed: Feb. 20, 2007

(65) Prior Publication Data

US 2007/0204563 A1 Sep. 6, 2007

(30) Foreign Application Priority Data

Feb. 21, 2006 (DE) ..... 10 2006 007 950

(51) Int. Cl.
*B65C 9/02* (2006.01)
*B65B 61/00* (2006.01)
*B67C 7/00* (2006.01)

(52) U.S. Cl. ..... 53/136.1; 53/167; 53/281; 156/DIG. 12; 156/DIG. 25

(58) Field of Classification Search ..... 53/136.1, 53/167, 281, 284.5; 156/DIG. 12, DIG. 13, 156/DIG. 25, DIG. 26
See application file for complete search history.

(56) References Cited

U.S. PATENT DOCUMENTS

| | | | | |
|---|---|---|---|---|
| 2,657,816 | A * | 11/1953 | Everett | 156/DIG. 12 |
| 2,826,022 | A * | 3/1958 | Austin | 53/136.1 |
| 7,060,143 | B1 * | 6/2006 | Eiban et al. | 156/DIG. 12 |
| 7,182,115 | B2 * | 2/2007 | Sindermann et al. | 156/363 |
| 2004/0099379 | A1 * | 5/2004 | Erich | 156/567 |
| 2005/0034423 | A1 * | 2/2005 | Sindermann et al. | 53/136.1 |
| 2005/0284103 | A1 * | 12/2005 | Hartness et al. | 53/136.1 |
| 2007/0193223 | A1 * | 8/2007 | Schach et al. | 53/167 |
| 2007/0204563 | A1 * | 9/2007 | Kramer et al. | 53/167 |

FOREIGN PATENT DOCUMENTS

| | | |
|---|---|---|
| DE | 1 902 437 U | 10/1964 |
| DE | 203 05 967 U1 | 7/2003 |
| DE | 202 21 208 U1 | 6/2005 |
| DE | 10 2004 054 057 A1 | 8/2005 |

* cited by examiner

*Primary Examiner*—Stephen F. Gerrity
(74) *Attorney, Agent, or Firm*—Nils H. Ljungman & Associates

(57) ABSTRACT

Beverage bottling plant for filling bottles with a liquid beverage filling material having an information adding station.

20 Claims, 7 Drawing Sheets

FIG. 3
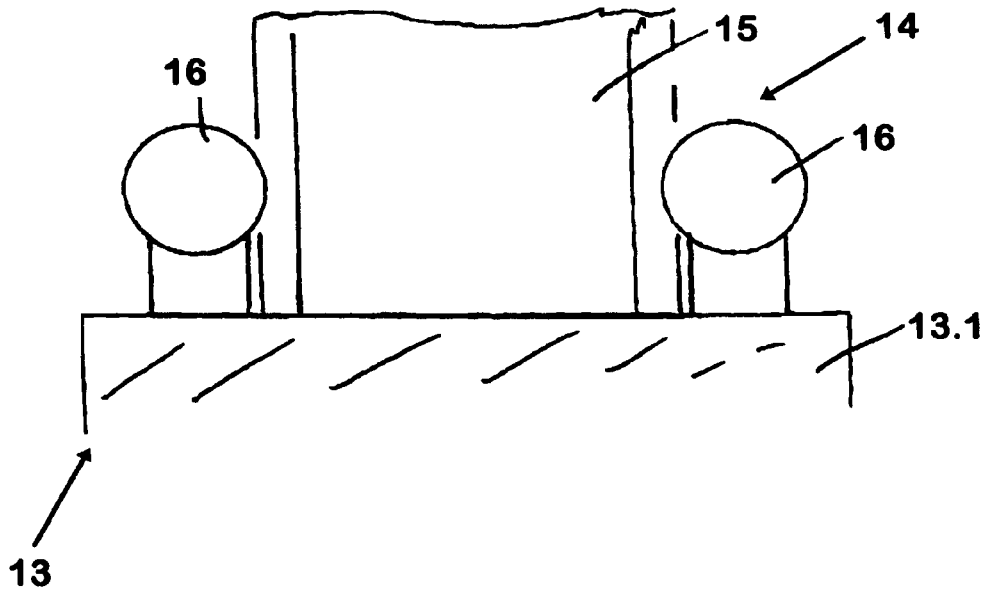
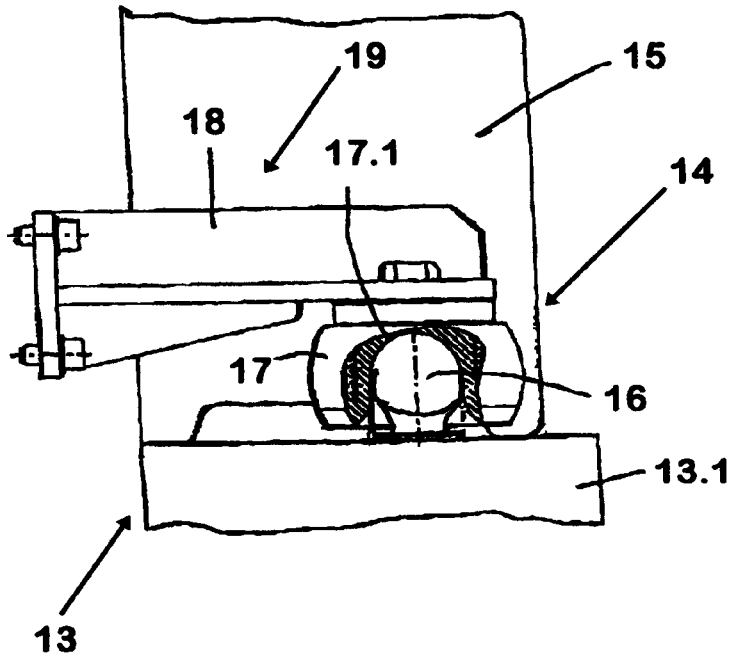
FIG. 4

BEVERAGE BOTTLING PLANT FOR FILLING BOTTLES WITH A LIQUID BEVERAGE FILLING MATERIAL HAVING AN INFORMATION ADDING STATION

BACKGROUND

1. Technical Field

This application relates to a beverage bottling plant for filling bottles with a liquid beverage filling material having an information adding station.

2. Background Information

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

Some beverage bottling plants may possibly comprise filling arrangements that receive a liquid beverage material from a toroidal or annular vessel, in which a supply of liquid beverage material is stored under pressure by a gas. The toroidal vessel may also be connected to at least one external reservoir or supply of liquid beverage material by a conduit or supply line. In some circumstances it may even be possible that a beverage bottling plant has two external supply reservoirs, each of which may be configured to store either the same liquid beverage product or different products. These reservoirs could possibly be connected to the toroidal or annular vessel by corresponding supply lines, conduits, or other arrangements. It is also possible that the external supply reservoirs could be in the form of simple storage tanks, or in the form of liquid beverage product mixers.

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine.

After a filling process has been completed, the filled beverage bottles are transported or conveyed to a closing machine, which is often a rotary closing machine. A revolving or rotary machine comprises a rotor, which revolves around a central, vertical machine axis. There may further be provided a conveyer arrangement configured to transfer filled bottles from the filling machine to the closing station. A transporting or conveying arrangement can utilize transport star wheels as well as linear conveyors. A closing machine closes bottles by applying a closure, such as a screw-top cap or a bottle cork, to a corresponding bottle mouth. Closed bottles are then usually conveyed to an information adding arrangement, wherein information, such as a product name or a manufacturer's information or logo, is applied to a bottle. A closing station and information adding arrangement may be connected by a corresponding conveyer arrangement. Bottles are then sorted and packaged for shipment out of the plant.

Many beverage bottling plants may also possibly comprise a rinsing arrangement or rinsing station to which new, non-return and/or even return bottles are fed, prior to being filled, by a conveyer arrangement, which can be a linear conveyor or a combination of a linear conveyor and a starwheel. Downstream of the rinsing arrangement or rinsing station, in the direction of travel, rinsed bottles are then transported to the beverage filling machine by a second conveyer arrangement that is formed, for example, by one or more starwheels that introduce bottles into the beverage filling machine.

It is a further possibility that a beverage bottling plant for filling bottles with a liquid beverage filling material can be controlled by a central control arrangement, which could be, for example, a computerized control system that monitors and controls the operation of the various stations and mechanisms of the beverage bottling plant.

A machine for the equipping of bottles or like containers is known in the form of a labeling machine of revolving design (German Patent No. 202 21 208 U1), in which at the periphery of a powered rotor configured to rotate about a vertical machine axis, several labeling machines are disposed so as to be free standing, i.e., standing with their own feet on a bottom. In order to attain the necessary positioning of the labeling machines in reference to the machine frame for the proper application of the equipment elements or, respectively, labels onto the bottles or containers, additional elements are disposed at the periphery of the machine frame, for the fixing of the position of the respective labeling machines relative to the machine frame.

The basic advantage of such a machine consists in the fact that by exchanging one or several labeling machines, a conversion of the machine from one container type or size to another container type or size, and/or from one equipment feature to another equipment feature is done trouble-free and is possible without large time consumption, also adjusting and setting work and/or repair can be carried out at the labeling machines separately from the labeling machine, and therefore can be carried out without production interruptions. However, a disadvantage of the known machine consists in the fact that the alignment of the respective labeling machine in reference to centering means, disposed at the machine frame, occurs in such a way that among other things the danger of damages at the labeling machine exists, or at the machine frame, during handling of the heavy labeling machines. Furthermore the centering means are difficult to access which signifies a complicated use.

OBJECT OR OBJECTS

An object of at least one possible embodiment of the present application is to provide a machine for equipping of bottles or like containers, which under retention of the basic advantage of interchangeable labeling machines, allows a simple docking of the machines to the periphery of the machine without a danger of damages.

SUMMARY

At least one possible embodiment of the present application is a machine configured for equipping of bottles or like containers, which machine includes at least one transport element for moving of the containers on a transport path at a machine frame as well as with at least one machine configured to perform labeling, which labeling machine is arranged to the side of the transport path and which is arranged, by way of centering elements in centered manner with reference to the transport path, on a bottom so as to be free standing, wherein the centering means are secured in independent manner, that is, the centering elements are secured on the bottom and separately from the machine.

In at least one possible embodiment of the present application, the centering means which serve to achieve aligned arrangement of the respective labeling machine, are provided separately from the machine at the bottom, or, respectively, on the floor of a plant in which the machine is used, at a support- and bearing carrier that is disposed separately with respect to the machine and standing on the bottom. These centering- and docking units then effect, while docking is done, in their cooperation automatically the respective height setting and the alignment of the labeling machines in relation to the labeling machine. Thereby the alignment of the labeling machines 11 is mainly also fixed in the rotary position around an axis disposed in parallel with an machine axis (EA). In at least one possible embodiment of the present application, the centering and docking units also serve to provide a load-transferring or load up-taking support-bearing or, respectively, a load-transferring or load up-taking support for the labeling machine, which then, in this case, for example, is standing only in the region of a side positioned away from the machine fame, e.g., by means of height-adjustable feet, on the bottom ground.

In at least one possible embodiment of the present application, the support-bearing, that is configured by at least one centering- and docking unit disposed on the side of the centering bearing and by at least one centering- and docking unit disposed on the side of the machine, in such a way that it can possibly perform a swing movement about a horizontal or substantially nearly horizontal axis, namely for the setting of the inclination of the labeling machines in relation to the horizontal. For this, the labeling machine supports itself by means of at least one foot that is adjustable as to height on the ground or bottom. The swing movement possibility for the setting of the inclination is reached, for example, by the fact that the at least one centering- and docking unit, disposed at the side of the centering bearing and/or the side of the machine, forms a support surface for a counter-surface at the at least one machine-sided and/or centering bearing-sided centering- and docking unit, and the (support surface) is curved about at least one axis that extends parallel to the swing axis or is curved in convex shape.

In another possible embodiment of the present application, the machine frame is also supported in a centered manner on centering- and support bearings for respectively at least one labeling machine. In at least one possible embodiment of the present application, a machine also provides the advantage of an unproblematic, quick exchange of the labeling machines, for example, to effect the equipment or rearrangement of the machine for use of another kind and/or size of the containers, in another kind of the equipment etc.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one possible embodiment of the present application is explained in greater detail below illustrated in the accompanying drawings, in which:

FIGS. 3 and 4 in simplistic individual views and in different views, shows one of the supporting or centering bearings which are secured to the periphery of the machine frame that comprises the rotor and away from this frame and which bearings are independently secured to a base or bottom;

DESCRIPTION OF EMBODIMENT OR EMBODIMENTS

Figure 1:
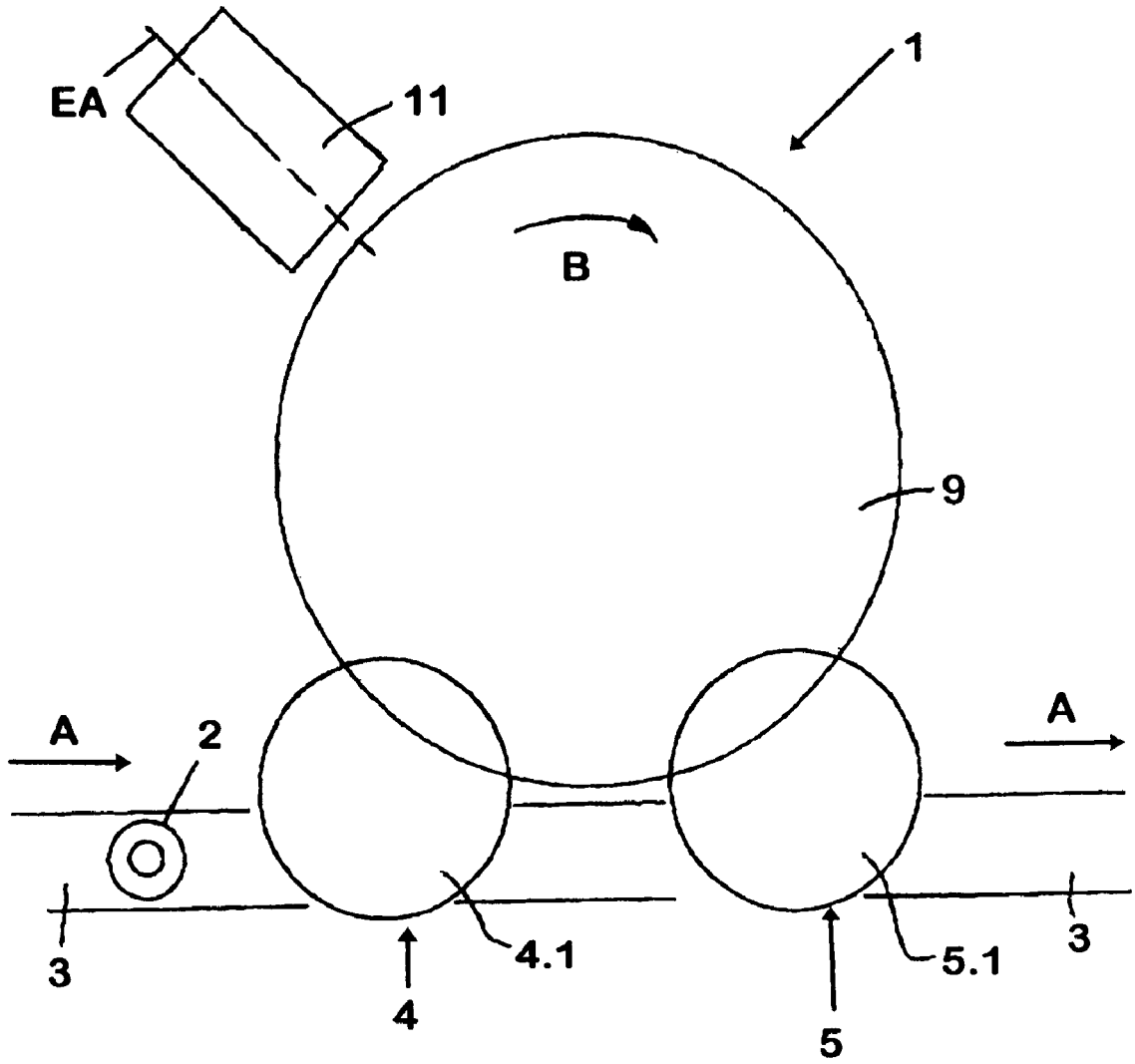
FIG. 1 in a simplistic representation, shows a plan view upon a machine for equipping bottles or like containers in the configuration of a labeling machine of revolving design.
Figure 1A:
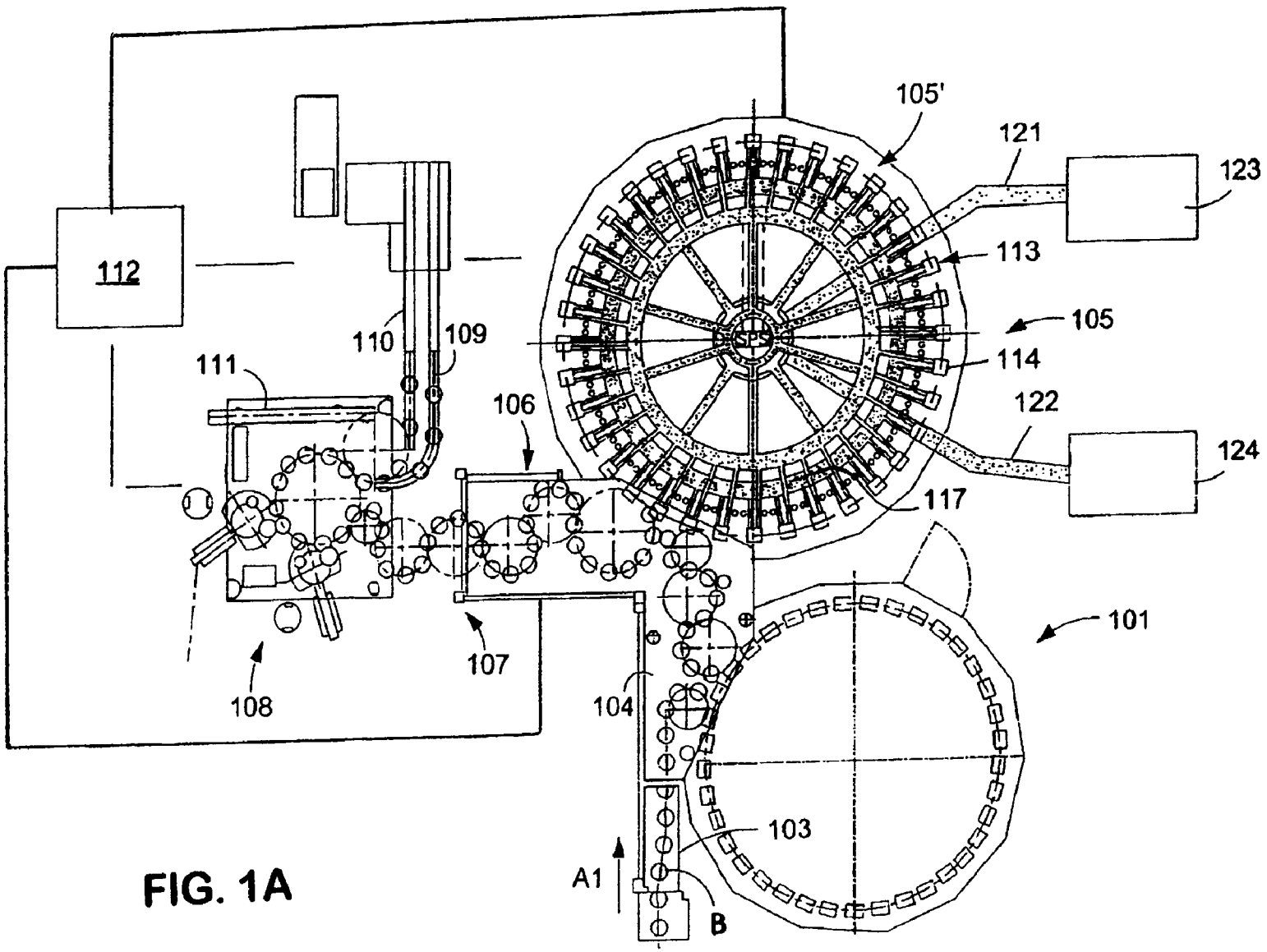
FIG. 1A shows schematically the main components of one possible embodiment example of a system for filling containers.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

In FIGS. 1-4, reference numeral 1 indicates a labeling machine which serves for equipping, i.e., for labeling of bottles 2 which are supplied by way of a conveyor 3 to a container inlet 4 or, respectively, to the input- or transfer star 4.1 on which they are disposed to be upright standing, i.e., with their bottle axis being oriented or substantially oriented in the vertical direction. Upon labeling of the bottles 2, they are handed over to a container outlet 5 or, respectively, with a thereat disposed outlet- or transfer star 5.1, again to the conveyor 3; and they are then supplied on this while upright standing to another stage of the operation.

In greater detail, the described labeling machine 1 is of the revolving design, i.e., it comprises among other things a powered rotor 9 disposed at a machine frame 8 which comprises several feet 6 for support on a base or bottom 7, which rotor is configured to rotate around a vertical machine axis in the direction indicated by the arrow 13, with the rotor 9 having at its circumference, in the manner known to the expert in the art, a plurality of support surfaces that are configured in such a way that onto them the bottles 2, respectively at the container inlet 4, are individually transferred and on which the bottles 2 are held, during the labeling process, by respectively over each support surface superposed stamp devices 10, holding being by clamping between a stamp device and the corresponding support surface.

Figure 2:
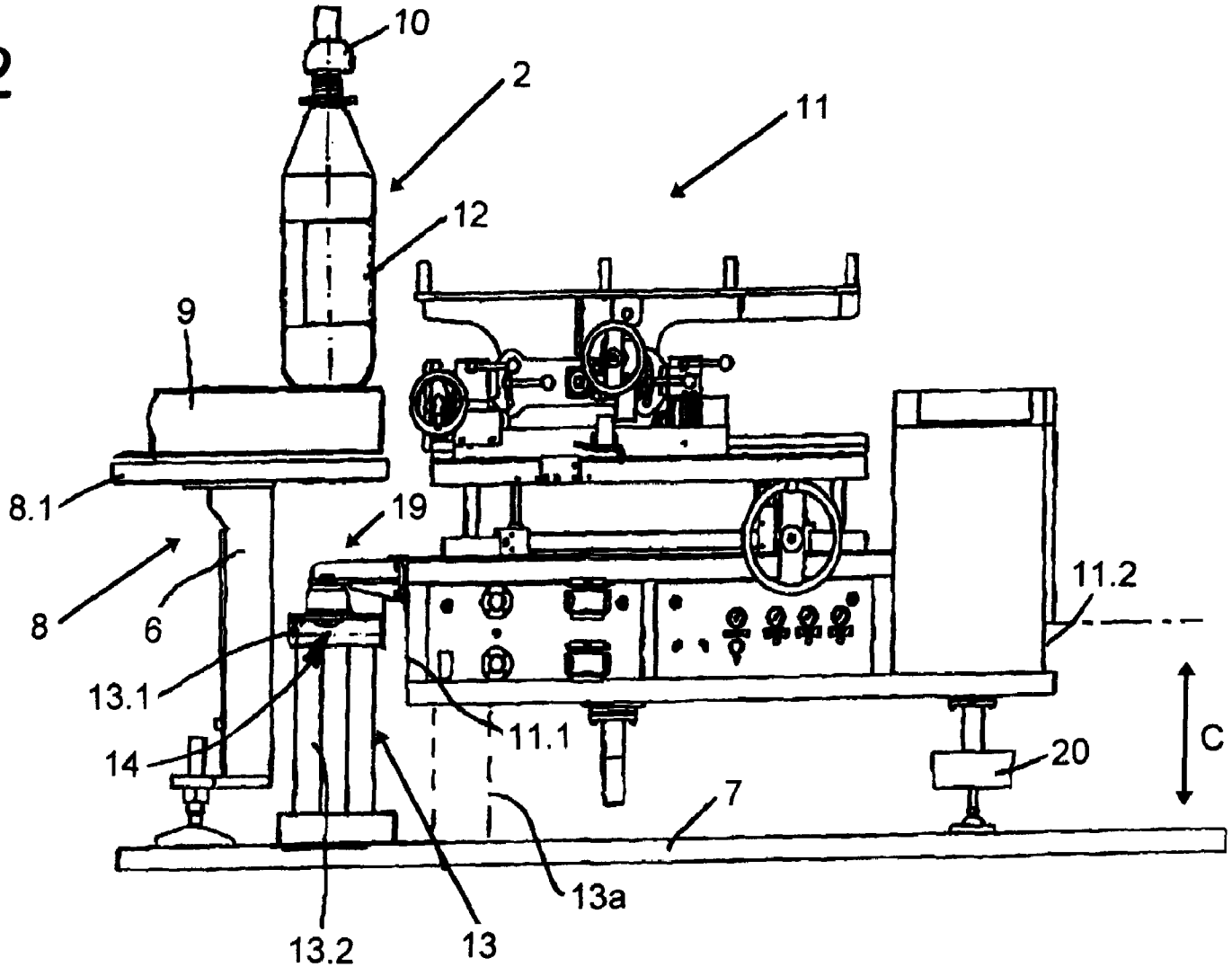
FIG. 2 in a side view, shows one at the periphery of the machine or the machine frame or machine structure arranged changeable labeling machines, together with a partial representation of the machine frame or machine table and the rotor which is configured to be powered so as to rotate about a vertical machine axis of the labeling machine.

At the periphery of the machine frame 8 or the rotor 9, there are disposed several labeling machines 11, of which in the FIGS. 1 and 2 is shown for easier representation only one. The labeling machines 11, which comprise all the functional elements necessary to affix labels 12 onto the bottles 2, are disposed to be free standing, are not arranged to rotate with the rotor 9 around in the periphery of the machine frame 8, and are replaceable, namely, in such a way that the labeling machine 1 can be converted merely by exchanging the labeling machines 12 easily and without large time consumption to convert from one bottle- or container type or size to another bottle- or container type or size; and/or from one label- or equipment type to another label- or equipment type.

As is shown in FIG. 2, at the periphery of the machine frame 8, or the rotor 9, and in the shown embodiment, yet below a ring-shaped machine table 8.1 concentrically surrounding the vertical machine axis, in each case there where a labeling machine 11 is arranged, or can be arranged, a centering- and support bearing 13 is disposed which is disposed to be independently, i.e., it is not connected to the machine frame 8 or another element of the machine, secured to the bottom 7, or is configured to stand on the bottom.

The centering- and support bearing 13 comprises, in the shown form of embodiment, for example, a flat-shaped carrier 13.1 having several feet 13.2 with which the horizontal carrier 13.1 is standing on the bottom 7, or is fastened onto this.

At the upper side of the centering- and support bearings 13 or the carrier 13.1, a centering- and docking unit 14 is provided; which comprises, in the shown form of embodiment, a guide element 15 that is secured at the carrier 13.1 and projects from this carrier, and also comprises two centering- and coupling elements 16, which when the centering- and supporting bearing 13 is mounted, are offset with respect to one another in the circumferential direction of the machine table 8.1. Each one of such centering- and coupling elements 16, disposed on the side of the centering bearing, is put in place, when the labeling machine 11 is positioned at the labeling machine 1, from above upon a centering- and coupling element 17 that is disposed on the side of the machine. The centering- and coupling elements 11 that are disposed on the side of the machine are planned to be in each case at an end of a carrier 18, which just as the centering- and coupling elements 17, is a component of a centering- and docking unit 19 disposed on the machine side, that are configured to be provided at the face side 11.1 of the labeling machine 11 that is facing toward the machine frame 8 and to project beyond such face side.

In the embodiments shown in the FIGS. 1-4, the two centering bearing-sided centering- and coupling elements 16 are shaped spherically. The machine-sided centering- and coupling elements 17 form in each case a recess 17.1 that is configured in conformity with the ball-head shape, in which—with at the periphery of the labeling machine 1*a* positioned labeling machine 11—is received in each case a centering- and coupling element 16, namely in such a way that the labeling machine in the area of its front side or face 11.1, by way of the two, in each case on a centering- and coupling element 16 disposed centering- and coupling elements 17, is supported so as to be capable of load-transfer in the centering- and support bearing 13, or, respectively, in the thereat disposed centering- and docking unit 14.

Since the respective centering and support bearing 13 during assembly of the labeling machine 1 is precisely aligned and also the height of the coupling elements 16 was adjusted or put most exactly, the respective labeling machine 11 has the required alignment or positioning, upon docking to the centering- and supporting bearing 13, by the two centering- and coupling elements 16 and by both machine-sided centering- and coupling elements 17, with their—to the centering- and coupling elements 16 adapted recesses or openings 17.1, that is necessary for the labeling, also in relation to its machine axis EA as well as at least at the side or face 11.1 also the necessary height position in relation to the machine table 8.1, or, respectively, rotor 9.

In the region of the side 11.2 remote from the centering- and support bearing 13, the labeling machine 11 supports itself with at least one own foot 20 on the bottom 7. In the embodiment of FIG. 2 such a foot is provided. As is indicated by the double arrow C, the feet 20 are height-adjustable. Through this a setting of the inclination of the labeling machines 11, or, respectively, of the machine axis EA is possible, namely under swinging of the labeling machines 11 about the swing bearing that is configured by the centering bearing-sided centering- and coupling elements 16 and the machine-sided centering- and coupling elements 17, which makes possible—for the setting of the inclination—a sufficiently large swing angle. The centering bearing-sided centering- and coupling elements 16 are, as described, shaped with a spherical head. Also other forms are conceivable, for example, the configuration of this centering- and coupling element as a plugs, that at their upper ends, that project beyond the carrer13.1, upon which here the machine-sided centering- and coupling elements 17 can be placed from above here, in the manner of a spherical calotte or, however, at least curved about at least one vertical, or essentially vertically to the axis EA oriented space- or bend curved axis, in convex manner. Docking of the respective labeling machines to the centering- and support bearing 13 is made easier by way of the guide element 15.

Each labeling machine 11 has its own drive for its functional units. This drive is synchronized, for example, electrically with the drive of the rotor 9. Furthermore, the functional elements of the labeling machines are at least partly adjustable provided at a frame of this machine. The specific feature of the labeling machine 1 consists according in the fact that the respective labeling machine 11 is supported bearing-like—at its side 11.1 that is disposed towards the machine frame, or, respectively, towards the rotor 9, by a centering- and support bearing 13 which is fastened fully independently from the machine frame 8 on the bottom 7.

By use of the centering- and support bearing 13 it is ensured, on the one hand, that the respective labeling machine 11—while docking, assumes the adjustment or alignment necessary for labeling and also the height position in relation to the machine, or, respectively, the rotor 9, i.e., a height adjustment, also at the side 11.1 that is positioned towards the machine frame 8, is not required. There is further achieved, by way of the use of an independent, on the bottom 7 fastened centering- and support bearing 13, for every labeling machine 11*a* weight relief for the machine frame 8, and as well a mechanical separation is reached furthermore between the machine frame and the respective labeling machine 11, so that also mechanical oscillations of the machine frame 8, which, e.g., are generated by the rotating rotor 9, are not transferred to the respective labeling machine 11.

Damages of the labeling machine or at the machine frame 8 are effectively avoided furthermore by the use of an independent centering- and support bearing 13 for the respective labeling machine 11 while docking and/or removing the relatively heavy labeling machines, as with suitable configuration also the possibility exists to provide the respective centering- and support bearing 13 far enough away at the side from the machine frame 8, for example, in such a way that it is positioned, as is shown in the FIG. 2 with discontinuous lines 13*a*, with respect to the periphery of the machine table 8.1, radially outwardly, below the labeling machine 11. Then the machine-sided centering- and docking unit 19 with the machine-sided docking elements 17 are likewise provided at the underside of the labeling machines 11.

Figure 5:
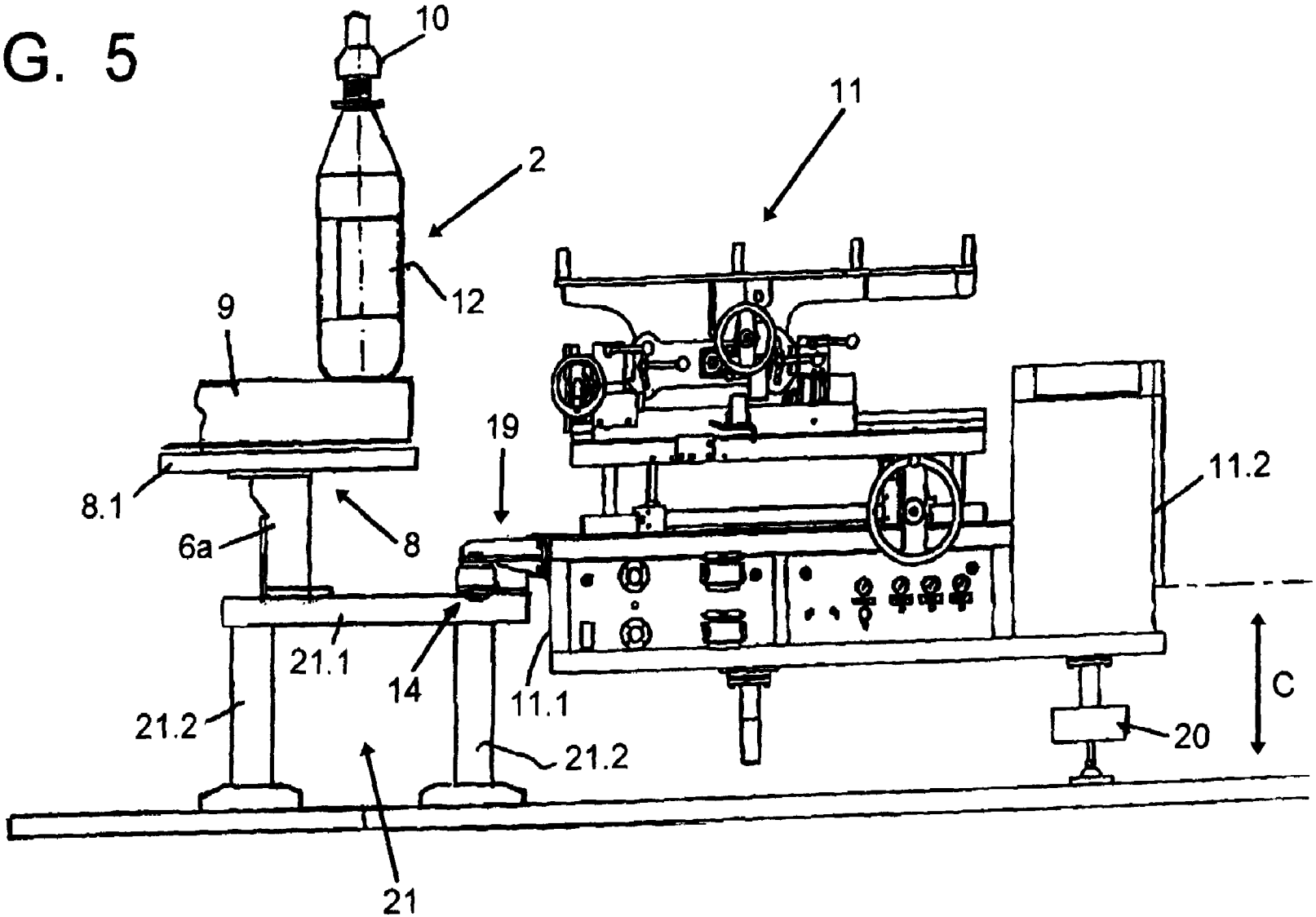
FIG. 5 in a representation like FIG. 2, show another possible execution form of at least one possible embodiment of the present application.
Figure 6:
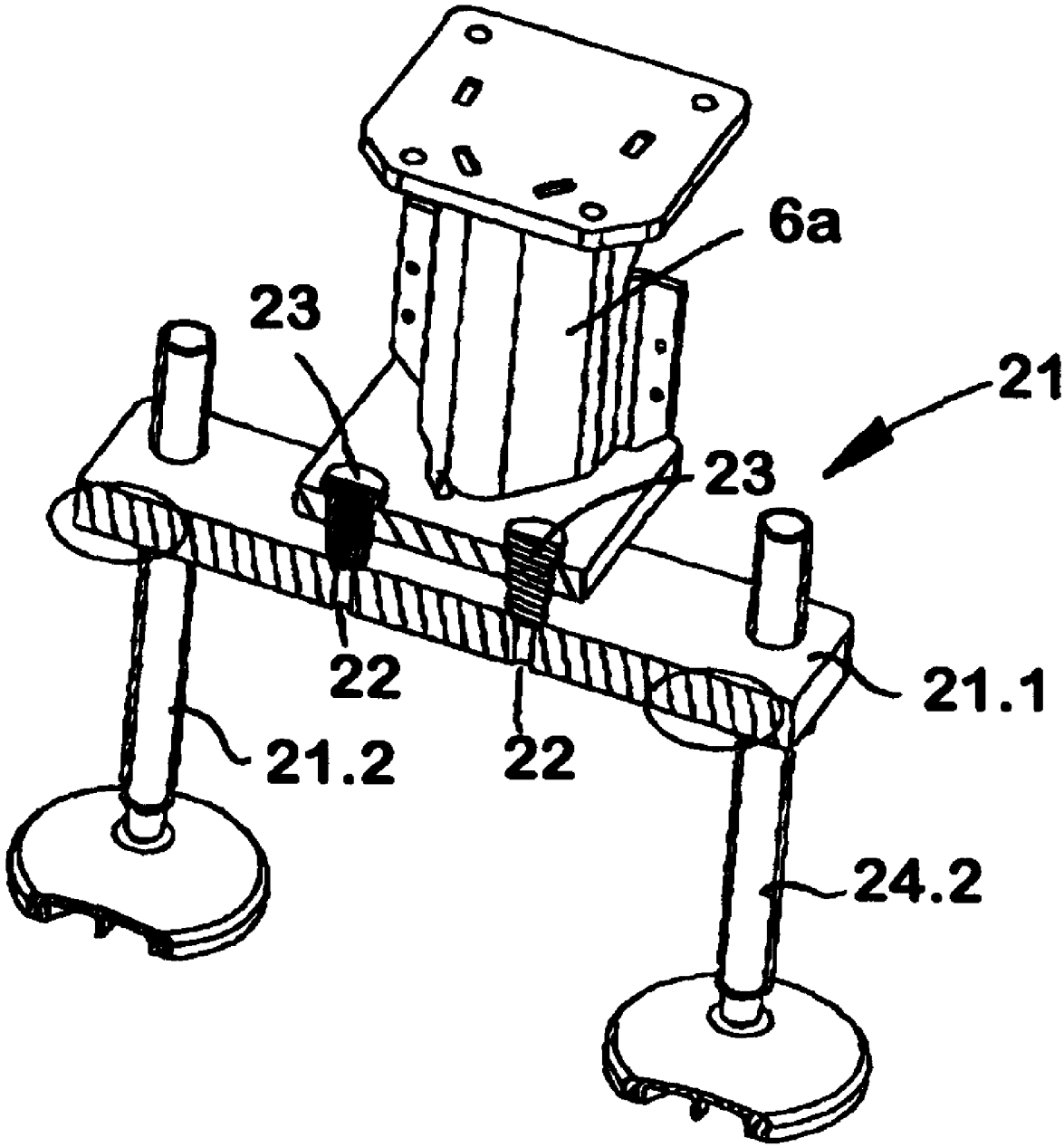
FIGS. 6 and 7 in different perspective representations, show one of the centering and supporting bearings of the labeling machine of FIG. 5.
Figure 7:
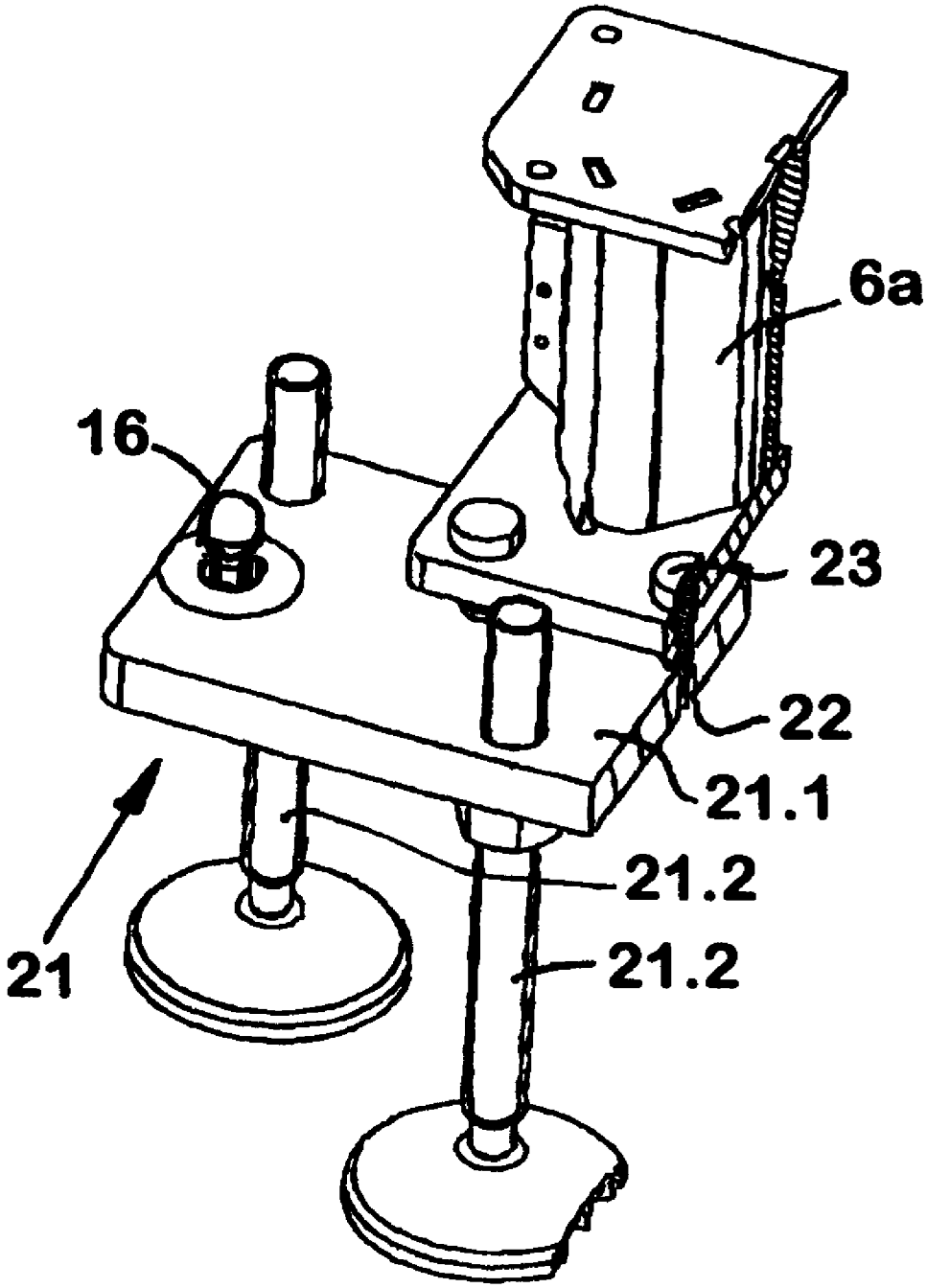

FIG. 5 shows in a representation like FIG. 2 as a further possible embodiment form, a labeling machine 1*a* which differs from the labeling machine 1 in the essentials only by the fact that instead of the centering- and support bearings 13 or 13*a*, centering- and support bearings 21 are provided upon which not only the machine frame 8 having shortened feet 6*a*, but also the respective labeling machine 11 are supported at the side 11.1. The centering- and support bearings 21 are provide again there where a labeling machine 11 is arranged, or possibly can be arranged. In at least one possible embodiment of the present application, there where the machine frame 8 comprises a foot, a centering- and support bearing 21 is provided.

Every centering- and support bearing 21 is configured by a carrier 21.1 and several feet 21.2 with which the carrier 21.1, or the centering- and support bearing 21, is fastened so as to be independently standing upon the bottom 7. At the carrier, the centering bearing-sided centering- and docking unit 14 is provided for the respective labeling machine 11 which comprises the two centering- and coupling elements 16 on which here then, with docked labeling machine 11, are placed in each case an machine-sided centering and coupling element 17 from above, as has been described in connection with FIGS. 1-4.

At the carrier bearer 21.1 furthermore two supports 22 are formed, into which in each case a projecting structure 23 intervenes. This centering projecting structure 23 is fastened to the underside of the foot 6*a* that is supported on the centering- and support bearing 21 or on the carrier 21.1.

This construction achieves, that the respective centering- and support bearing 21, although independently standing on the bottom 7, as well as also the centering bearing-sided centering- and docking unit 14, are precisely aligned in relation to the machine, or, respectively, the machine frame 8. Upon docking of the respective labeling machine 11 with the machine-sided centering- and docking unit 19 onto the centering bearing-sided centering- and docking unit 14 that is provided on the upper side of the carrier 21.1, also the respective labeling machine 11 is aligned precisely with regard to height setting and orientation of its axis EA to the labeling machine, or, respectively, to the machine frame 8, for example, with the axis EA being disposed radially to the vertical machine axis of the rotor 9. By means of the height-adjustable feet 20, a setting of the inclination of the labeling machines 11 is possible by this embodiment again as this is indicated in FIG. 5 also with the double arrow C.

It is common for both labeling machines 1 and 1*a*, that the respective labeling machine is not immediately supported at the machine frame 8, and that also the means for fixing of the position, or the orientation of the respective labeling machines 11 (centering- and docking units 14 and 19 and the coupling thereat disposed centering elements 16, or, respectively, 17) are not provided at the machine frame 8, but are provided at an independently disposed separate centering- and support bearing 13 or 21.

The labeling machine 1*a* affords basically the same advantages as they were given in the foregoing for the labeling machine 1, namely with the possibility of a quick and trouble-free exchange of the labeling machines 11, a relief of the machine frame 8 from the weight of the respective labeling machines 11, an automatic alignment adjustment of the labeling machines 11 on docking in reference to the labeling machine, an improved accessibility, a reduction of the danger of damages of the labeling machine or the machine frame 8 during docking of and removing of the labeling machines 11, the possibility of a setting of the inclination of the labeling machines as well as, also a mechanical decoupling between a labeling machine and a labeling machine, or, respectively, machine frame 8.

Developments of at least one possible embodiment of the present application are described herein. It is to be understood that numerous changes as well as variations are possible without departing from the inventive teaching underlying the present application.

For a machine for equipping of bottles or the like containers, which machine includes at least one transport element for moving of the containers on a transport path at a machine frame as well as with at least one machine configured to perform labeling, which labeling machine is arranged to the side of the transport path and which is arranged, by way of centering elements in centered manner with reference to the transport path, on a bottom so as to be free standing, the centering elements are secured in independent manner, that is, the centering elements are secured on the bottom and separately from the machine.

One feature or aspect of an embodiment is believed at the time of the filing of this patent application to possibly reside broadly in a machine for equipping of bottles 2 or the like containers, which machine includes at least one transport element 9 for moving of the containers 2 on a transport path at a machine frame 8 as well as with at least one machine 11 configured to perform labeling, which labeling machine is arranged to the side of the transport path 9 and which is arranged, by way of centering elements 16, 17 in centered manner with reference to the transport path, on a bottom 7 so as to be free standing, wherein that the centering means 14, 19 are secured in independent manner, that is, the centering elements are secured on the bottom 7 and separately from the machine.

Another feature or aspect of an embodiment is believed at the time of the filing of this patent application to possibly reside broadly in the machine, wherein that the centering means are configured by at least one centering- and docking unit 14 that is disposed at least one centering- and support bearing 13, 13*a*; 21 at the side of the centering bearing, as well as a centering- and/or docking unit 19 which is configured to cooperate with the centering- and docking unit 14, and that the pertaining respective centering and support bearings 13, 21 are secured in independent manner on the bottom 7.

Yet another feature or aspect of an embodiment is believed at the time of the filing of this patent application to possibly reside broadly in the machine, wherein that by way of the centering means, or the centering- and docking units 14, 19 that are configured to provide the structure of such centering means, there is only carried out a centering effort of the labeling machine 11 in reference to the machine frame 8, during which effort there does not arise a transfer of load upon the centering- and docking unit 14, 19.

Still another feature or aspect of an embodiment is believed at the time of the filing of this patent application to possibly reside broadly in the machine, wherein that centering means, or the centering- and docking units 14, 19 that are configured to provide the structure of such centering means, serve at the same time as load transferring or load supporting support for the labeling machine 11.

A further feature or aspect of an embodiment is believed at the time of the filing of this patent application to possibly reside broadly in the machine, wherein that for adjustment of the inclination of the labeling machine 11, the centering means or the centering- and docking units 14, 19 respectively disposed at the side of the centering bearing and/or at the side of the machine that are configured to provide the structure of the centering means, are configured to perform a swing movement which achieves the adjustment of the inclination about a horizontal or substantially nearly horizontal swing axis.

Another feature or aspect of an embodiment is believed at the time of the filing of this patent application to possibly reside broadly in the machine, wherein that the labeling machine 11 is configured with at least one foot structure 20 configured to be adjustable as to height.

Yet another feature or aspect of an embodiment is believed at the time of the filing of this patent application to possibly reside broadly in the machine, wherein that the at least one centering- and docking unit 14 and/or the at least one centering- and docking unit 19 that is disposed on the side of the machine, comprises at least one support surface against which is in contact an opposite surface of one of (a) the centering- and docking unit 19, or (b) the centering- and docking unit 14.

Still another feature or aspect of an embodiment is believed at the time of the filing of this patent application to possibly reside broadly in the machine, wherein that that the support surface is configured in such a way that it is curved in convex manner about an axis that extends parallel to the swing axis.

A further feature or aspect of an embodiment is believed at the time of the filing of this patent application to possibly reside broadly in the machine, wherein that the at least one support surface is configured in the shape of a sphere or in the shape of a portion of a sphere.

Another feature or aspect of an embodiment is believed at the time of the filing of this patent application to possibly reside broadly in the machine, wherein that the at least one support surface is configured by a surface or partial surface of a cylinder structure Yet another feature or aspect of an embodiment is believed at the time of the filing of this patent application to possibly reside broadly in the machine, wherein that the centering- and docking unit 14 has at least two support surfaces or coupling- and centering elements 16 that are disposed at a distance with respect to one another.

Still another feature or aspect of an embodiment is believed at the time of the filing of this patent application to possibly reside broadly in the machine, wherein that the at least two support surfaces are disposed in off-set relationship with respect to one anther in the direction of the swing axis.

A further feature or aspect of an embodiment is believed at the time of the filing of this patent application to possibly reside broadly in the machine, wherein that the support surface is configured by a centering- and coupling element.

Another feature or aspect of an embodiment is believed at the time of the filing of this patent application to possibly reside broadly in the machine, wherein that the centering- and coupling element 16 is configured by a ball-shaped head or a pin structure which has an end that is rounded.

Yet another feature or aspect of an embodiment is believed at the time of the filing of this patent application to possibly reside broadly in the machine, wherein that the centering- and coupling element is configured by a pin structure.

Still another feature or aspect of an embodiment is believed at the time of the filing of this patent application to possibly reside broadly in the machine, wherein that the machine fame 8 is also supported on the centering- and support bearing 21, for example, by means of feet 6*a*.

A further feature or aspect of an embodiment is believed at the time of the filing of this patent application to possibly reside broadly in the machine, wherein that the transport element is configured by a rotor 9 which can be driven so as to rotate about a vertical machine axis.

Another feature or aspect of an embodiment is believed at the time of the filing of this patent application to possibly reside broadly in the machine, wherein that the centering- and docking unit 14 and/or the coupling- or centering elements 16 are configured to fix the alignment of the labeling machine 11 on the side of the centering bearing with respect to height and/or the position of the rotation about an axis that is disposed parallel to the axis EA of the machine.

Some examples of bottling and container handling systems and components thereof which may possibly be utilized or adapted for use in at least one possible embodiment, may possibly be found in the following U.S. patents: U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" U.S. Pat. No. 7,024,841, entitled "Labeling Machine with a Sleeve Mechanism for Preparing and Applying Cylindrical Labels onto Beverage Bottles and Other Beverage Containers in a Beverage Container Filling Plant;" No. 6,971,219 entitled "Beverage Bottling Plant for Filling Bottles with a Liquid Beverage Filling Material and a Labeling Station for Labeling Filled Bottles and Other Containers;" U.S. Pat. No. 6,973,767, entitled "Beverage bottling plant and a conveyor arrangement for transporting packages;" U.S. Pat. No. 7,013,624, entitled "Beverage bottling plant for filling bottles with a liquid beverage filling material, a container filling plant container information adding station, such as, a labeling station, configured to add information to containers, such as, bottles and cans, and modules for labeling stations;" U.S. Pat. No. 7,108,025, entitled "Beverage Bottling Plant for Filling Bottles with a Liquid Beverage Filling Material, and a Container Filling Lifting Device for Pressing Containers to Container Filling Machines;" U.S. Pat. No. 7,062,894, entitled "Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" U.S. Pat. No. 7,010,900, entitled "Beverage Bottling Plant for Filling Bottles with a Liquid Beverage Filling Material, and a Cleaning Device for Cleaning Bottles in a Beverage Bottling Plant;" U.S. Pat. No. 6,918,417, entitled "A Beverage Bottling Plant for Filling Bottles with a Liquid Beverage Filling Material, and an Easily Cleaned Lifting Device in a Beverage Bottling Plant;" U.S. Pat. No. 7,065,938, entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" U.S. Pat. No. 6,901,720, entitled "A Beverage Bottling Plant for Filling Bottles with a Liquid Beverage Filling Material, and Apparatus for Attaching Carrying Grips to Containers with Filled Bottles;" and U.S. Pat. No. 7,121,062 "Beverage bottling plant for filling bottles with a liquid beverage filling material, having a container handling machine with interchangeable receptacles for the container mouth."

The components disclosed in the various publications, disclosed or incorporated by reference herein, may possibly be used in possible embodiments of the present invention, as well as equivalents thereof.

Some examples of bottling and container handling systems and components thereof which may possibly be utilized or adapted for use in at least one possible embodiment, may possibly be found in the following U.S. patent applications: Ser. No. 10/723,451, filed on Nov. 26, 2003, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/865,240, filed on Jun. 10, 2004, Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, entitled "A Beverage Bottling Plant for Filling Bottles with a Liquid Beverage Filling Material, Having an Apparatus for Exchanging Operating Units Disposed at Rotating Container Handling Machines;" Ser. No. 10/954,012, filed on Sep. 29, 2004, Ser. No. 10/952,706, Ser. No. 10/962,183, filed on Oct. 8, 2004, Ser. No. 10/967,016, filed on Oct. 15, 2004, Ser. No. 10/982,706, filed on Nov. 5, 2004, Ser. No. 10/982,694, Ser. No. 10/982,710, Ser. No. 10/984,677, filed on Nov. 9, 2004, Ser. No. 10/985,640, filed on Nov. 10, 2004, Ser. No. 11/004,663, filed on Dec. 3, 2004, No. 11/009,551, filed on Dec. 10, 2004, Ser. No. 11/012,859, filed on Dec. 15, 2004, Ser. No. 11/014,673, filed on Dec. 16, 2004, Ser. No. 11/016,364, filed on Dec. 17, 2004, and Ser. No. 11/016,363.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of bottling systems, which may be used or adapted for use in at least one possible embodiment of the present may be found in the following U.S. patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

The appended drawings in their entirety, including all dimensions, proportions and/or shapes in at least one embodiment of the invention, are accurate and are hereby included by reference into this specification.

Some examples of labeling machines which may possibly be utilized in at least one possible embodiment may possibly be found in the following U.S. patents: U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of control systems which measure operating parameters and learn therefrom that may possibly be utilized or possibly adapted for use in at least one possible embodiment of the present application may possibly be found in the following U.S. patents: U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application.

However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application." may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action dated Oct. 11, 2006, and/or cited elsewhere are hereby incorporated by reference as if set forth in their entirety herein as follows: German Patent No. 10 2004 054 057 A1, German Patent No. 203 05 967 U1, German Patent No. 1 902 437 U.

The corresponding foreign and international patent publication applications, namely, Federal Republic of Germany Patent Application No. 10 2006 007 950.7, filed on Feb. 21, 2006, having inventors Klaus KRÄMER, Siegmar SINDERMANN, Martin SCHACH, Winfried SCHLÜTER, and DE-OS 10 2006 007 950.7 and DE-PS 10 2006 007 950.7, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(*b*). As stated in 37 C.F.R. §1.72 (*b*):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1, 1*a* Labeling machine
2 Bottle
3 Transporter or conveyer
4 Container inlet
4.1 Input star
5 Container outlet
5.1 Output star
6,6*a* Foot portion of the machine frame
7 Base or bottom
8 Machine frame
9 Rotor
10 Stamp device
11 Labeling machine
11.1, 11.2 Side of the labeling machine 11
12 Label
13 Centering and support bearing
13.1 Carrier
13.2 Foot portion
14 Centering- and docking unit that is disposed at the side of the centering bearing
15 Guide element
15.1 Guide surface
16 Centering- and coupling element disposed on the side of the centering bearing
17 Centering- and coupling element disposed on the side of the machine
17.1 Opening or receiving structure
18 Carrier or carrier elements for the centering- and coupling elements disposed on the side of the machine
19 Centering- and docking unit disposed on the side of the machine
20 Foot structure configured to be adjustable as to height
21 Centering- and support bearing
21.1 Carrier
23.2 Foot
22 Support
23 Adjusting element- or projection structure at the foot portion 6*a*
A Direction of transport of bottles 2
B Direction of rotation of rotor 9
C Height adjustment of the labeling machine
EA Central axis of the labeling machine

What is claimed is:

1. A beverage bottling plant for filling beverage bottles with liquid beverage material, said beverage bottling plant comprising:

a plurality of rotary machines comprising at least a rotary beverage bottle filling machine, a rotary beverage bottle closing machine, and a rotary beverage bottle information adding machine;

a first conveyor arrangement being configured and disposed to convey beverage bottles to be filled to said beverage bottle filling machine;

said beverage bottle filling machine being configured and disposed to fill beverage bottles with liquid beverage material;

said beverage bottle filling machine comprising:

a rotor;

a rotatable vertical machine column;

said rotor being connected to said vertical machine column to permit rotation of said rotor about said vertical machine column;

a plurality of beverage bottle filling elements for filling beverage bottles with liquid beverage material being disposed on the periphery of said rotor;

each of said plurality of beverage bottle filling elements comprising a container carrier being configured and disposed to receive and hold beverage bottles to be filled;

each of said plurality of beverage bottle filling elements being configured and disposed to dispense liquid beverage material into beverage bottles to be filled;

at least one liquid reservoir being configured to hold a supply of liquid beverage material;

at least one supply line being configured and disposed to connect said at least one liquid reservoir to said beverage bottle filling machine to supply liquid beverage material to said beverage bottle filling machine;

a first star wheel structure being configured and disposed to move beverage bottles into said beverage bottle filling machine; and a second star wheel structure being configured and disposed to move beverage bottles out of said beverage bottle filling machine;

a second conveyor arrangement being configured and disposed to convey filled beverage bottles from said beverage bottle filling machine to said beverage bottle closing machine;

said beverage bottle closing machine being configured and disposed to close tops of filled beverage bottles;

said beverage bottle closing machine comprising:

a rotor;

a rotatable vertical machine column;

said rotor being connected to said vertical machine column to permit rotation of said rotor about said vertical machine column;

a plurality of closing devices being disposed on the periphery of said rotor;

each of said plurality of closing devices being configured and disposed to place closures on filled beverage bottles;

each of said plurality of closing devices comprising a container carrier being configured and disposed to receive and hold filled beverage bottles;

a first star wheel structure being configured and disposed to move filled beverage bottles into said beverage bottle closing machine; and a second star wheel structure being configured and disposed to move filled, closed beverage bottles out of said beverage bottle closing machine;

a third conveyor arrangement being configured and disposed to convey filled, closed beverage bottles from said beverage bottle closing machine to said beverage bottle information adding machine;

said beverage bottle information adding machine being configured and disposed to label filled, closed beverage bottles;

said beverage bottle information adding machine comprising:

a rotor;

a rotatable vertical machine column;

said rotor being connected to said vertical machine column to permit rotation of said rotor about said vertical machine column;

a plurality of beverage bottle support structures being disposed on the periphery of said rotor;

said beverage bottle support structures being configured to support and hold filled, closed beverage bottles;

a first star wheel structure being configured and disposed to move filled, closed beverage bottles into said beverage bottle information adding machine;

a second star wheel structure being configured and disposed to move labeled beverage bottles out of said beverage bottle information adding machine;

at least one beverage bottle information adding device being configured and disposed to add information to a beverage bottle;

said at least one beverage bottle information adding device being disposed to the side of said rotor outside the perimeter of said rotor;

centering elements being disposed on the floor of said beverage bottling plant and separate from said rotor and vertical machine column; and said at least one beverage bottle information adding device being connected to and centered by said centering elements.

2. The beverage bottling plant according to claim 1, wherein the centering means are configured by at least one centering and docking unit that is disposed at at least one centering and support bearing at the side of the centering bearing, as well as a centering and/or docking unit which is configured to cooperate with the centering and docking unit, and that the pertaining respective centering and support bearings are secured in independent manner on the floor.

3. The beverage bottling plant according to claim 2, wherein:

(A) by way of the centering means, or the centering and docking units that are configured to provide the structure of such centering means, there is only carried out a centering effort of the information adding machine in reference to the machine frame, during which effort there does not arise a transfer of load upon the centering and docking unit; or (B) centering means, or the centering and docking units that are configured to provide the structure of such centering means, serve at the same time as load transferring or load supporting support for the information adding machine.

4. The beverage bottling plant according to claim 3, wherein for adjustment of the inclination of the information adding machine, the centering means or the centering and docking units respectively disposed at the side of the centering bearing and/or at the side of the machine that are configured to provide the structure of the centering means, are configured to perform a swing movement which achieves the adjustment of the inclination about a horizontal or substantially nearly horizontal swing axis.

5. The beverage bottling plant according to claim 4, wherein the information adding machine is configured with at least one foot structure configured to be adjustable as to height.

6. The beverage bottling plant according to claim 5, wherein:

the at least one centering and docking unit and/or the at least one centering and docking unit that is disposed on the side of the machine, comprises at least one support surface against which is in contact an opposite surface of one of: (a) the centering and docking unit, or (b) the centering and docking unit; and the support surface is configured in such a way that it is curved in convex manner about an axis that extends parallel to the swing axis.

7. The beverage bottling plant according to claim 6, wherein:

the at least one support surface is configured in the shape of a sphere or in the shape of a portion of a sphere;

the at least one support surface is configured by a surface or partial surface of a cylinder structure; and the centering and docking unit has at least two support surfaces or coupling and centering elements that are disposed at a distance with respect to one another.

8. The beverage bottling plant according to claim 7, wherein:

the at least two support surfaces are disposed in off-set relationship with respect to one anther in the direction of the swing axis; and the support surface is configured by a centering and coupling element.

9. The beverage bottling plant according to claim 8, wherein:

the centering and coupling element is configured by a ball-shaped head or a pin structure which has an end that is rounded; and the centering and coupling element is configured by a pin structure.

10. The beverage bottling plant according to claim 9, wherein:

the machine frame is also supported on the centering and support bearing by means of feet; and the centering and docking unit and/or the coupling or centering elements are configured to fix the alignment of the information adding machine on the side of the centering bearing with respect to height and/or the position of the rotation about an axis that is disposed parallel to the axis EA of the machine.

11. A container filling plant for filling containers, said container filling plant comprising:

a plurality of rotary machines comprising at least a rotary container filling machine, a rotary container closing machine, and a rotary container information adding machine;

a first conveyor arrangement being configured and disposed to convey containers to be filled to said container filling machine;

said container filling machine being configured and disposed to fill containers;

said container filling machine comprising:

a rotor;

a rotatable vertical machine column;

said rotor being connected to said vertical machine column to permit rotation of said rotor about said vertical machine column;

a plurality of container filling elements for filling containers being disposed on the periphery of said rotor;

each of said plurality of container filling elements comprising a container carrier being configured and disposed to receive and hold containers to be filled;

a first star wheel structure being configured and disposed to move containers into said container filling machine; and a second star wheel structure being configured and disposed to move containers out of said container filling machine;

a second conveyor arrangement being configured and disposed to convey filled containers from said container filling machine to said container closing machine;

said container closing machine being configured and disposed to close tops of filled containers;

said container closing machine comprising:

a rotor;

a rotatable vertical machine column;

said rotor being connected to said vertical machine column to permit rotation of said rotor about said vertical machine column;

a plurality of closing devices being disposed on the periphery of said rotor;

each of said plurality of closing devices being configured and disposed to place closures on filled containers;

each of said plurality of closing devices comprising a container carrier being configured and disposed to receive and hold filled containers;

a first star wheel structure being configured and disposed to move filled containers into said container closing machine; and a second star wheel structure being configured and disposed to move filled, closed containers out of said container closing machine;

a third conveyor arrangement being configured and disposed to convey filled, closed containers from said container closing machine to said container information adding machine;

said container information adding machine being configured and disposed to label filled, closed containers;

said container information adding machine comprising:

a rotor;

a rotatable vertical machine column;

said rotor being connected to said vertical machine column to permit rotation of said rotor about said vertical machine column;

a plurality of container support structures being disposed on the periphery of said rotor;

said container support structures being configured to support and hold filled, closed containers;

a first star wheel structure being configured and disposed to move filled, closed containers into said container information adding machine;

a second star wheel structure being configured and disposed to move labeled containers out of said container information adding machine;

at least one container information adding device being configured and disposed to add information to a container;

said at least one container information adding device being disposed to the side of said rotor outside the perimeter of said rotor;

centering elements being disposed on the floor of said container filling plant and separate from said rotor and vertical machine column; and said at least one container information adding device being connected to and centered by said centering elements.

12. The container filling plant according to claim 11, wherein the centering means are configured by at least one centering and docking unit that is disposed at at least one centering and support bearing at the side of the centering bearing, as well as a centering and/or docking unit which is configured to cooperate with the centering and docking unit, and that the pertaining respective centering and support bearings are secured in independent manner on the floor.

13. The container filling plant according to claim 12, wherein:

(A) by way of the centering means, or the centering and docking units that are configured to provide the structure of such centering means, there is only carried out a centering effort of the information adding machine in reference to the machine frame, during which effort there does not arise a transfer of load upon the centering and docking unit; or (B) centering means, or the centering and docking units that are configured to provide the structure of such centering means, serve at the same time as load transferring or load supporting support for the information adding machine.

14. The container filling plant according to claim 13, wherein for adjustment of the inclination of the information adding machine, the centering means or the centering and docking units respectively disposed at the side of the centering bearing and/or at the side of the machine that are configured to provide the structure of the centering means, are configured to perform a swing movement which achieves the adjustment of the inclination about a horizontal or substantially nearly horizontal swing axis.

15. The container filling plant according to claim 14, wherein the information adding machine comprises a labeling machine and is configured with at least one foot structure configured to be adjustable as to height.

16. The container filling plant according to claim 15, wherein:

the at least one centering and docking unit and/or the at least one centering and docking unit that is disposed on the side of the machine, comprises at least one support surface against which is in contact an opposite surface of one of: (a) the centering and docking unit, or (b) the centering and docking unit; and the support surface is configured in such a way that it is curved in convex manner about an axis that extends parallel to the swing axis.

17. The container filling plant according to claim 16, wherein:

the at least one support surface is configured in the shape of a sphere or in the shape of a portion of a sphere;

the at least one support surface is configured by a surface or partial surface of a cylinder structure; and the centering and docking unit has at least two support surfaces or coupling and centering elements that are disposed at a distance with respect to one another.

18. The container filling plant according to claim 17, wherein:

the at least two support surfaces are disposed in off-set relationship with respect to one another in the direction of the swing axis; and the support surface is configured by a centering and coupling element.

19. The container filling plant according to claim 18, wherein:

the centering and coupling element is configured by a ball-shaped head or a pin structure which has an end that is rounded; and the centering and coupling element is configured by a pin structure.

20. The container filling plant according to claim 19, wherein:

the machine frame is also supported on the centering and support bearing by means of feet; and the centering and docking unit and/or the coupling or centering elements are configured to fix the alignment of the information adding machine on the side of the centering bearing with respect to height and/or the position of the rotation about an axis that is disposed parallel to the axis EA of the machine.

* * * * *